United States Patent [19]

Matsui et al.

[11] 4,063,437

[45] Dec. 20, 1977

[54] LOCK STRUCTURE

[75] Inventors: Iwao Matsui, Inazawa; Yoshimitsu Ebisu, Nagoya, both of Japan

[73] Assignee: Tokai Rika Denki Seisakusho K.K., Aichi, Japan

[21] Appl. No.: 686,063

[22] Filed: May 13, 1976

[30] Foreign Application Priority Data

Dec. 9, 1975 Japan ..... 50-167016[U]

[51] Int. Cl.[2] ..... E05B 27/06

[52] U.S. Cl. ..... 70/358; 70/337; 70/380; 70/411

[58] Field of Search ..... 70/151, 152, 153, 358, 70/379 R, 379 A, 380, 337, 411; 292/150, 165, 166, 185

[56] References Cited

U.S. PATENT DOCUMENTS

| | | | |
|---|---|---|---|
| 888,268 | 5/1908 | Sparks | 292/165 |
| 1,808,219 | 6/1931 | Hall | 70/151 |
| 3,167,943 | 2/1965 | Screiber | 70/358 |
| 3,777,520 | 12/1973 | Crepinsek | 70/358 |

FOREIGN PATENT DOCUMENTS

| | | | |
|---|---|---|---|
| 28,473 | 5/1908 | United Kingdom | 292/166 |

*Primary Examiner*—Robert L. Wolfe
*Attorney, Agent, or Firm*—Koda and Androlia

[57] ABSTRACT

A cylindrically shaped lock structure adapted to receive an associated rod-shaped key is disclosed. The lock comprises a rotor case having an annular rotor member disposed therein. The rotor member contains a plurality of slidable pin members radially extending into a central key opening in the rotor member. The key opening is arranged and configured to receive the associated rod key such that when the rod key is inserted, the pin members retract into the rotor case and selectively render the rotor movable therein. A latch actuating system is coupled to the rotor member via an arm member whereby rotation of the rotor member causes the actuating system to render a latch movable from its initially closed position to an open position.

8 Claims, 4 Drawing Figures

LOCK STRUCTURE

BACKGROUND OF THE INVENTION

1. Field of the Invention

The present invention relates to the field of lock structures, and more specifically, to a lock structure which is activated by an associated rod key.

2. Prior Art

It is well known in the art that common door locks are designed such that one key can open and close a specific door. It is also well known in the art that a common key lock system is available in which one key can lock and unlock a plurality of different doors. In such a system, there are multiple cylinders in the lock structure, but activation of specific cylinders by a single key causes the door lock to be movable from the locked position to the unlocked position. In apartments and the like, this lock has the advantage of permitting each resident to use a single key for both the cylinder on the communal front door used by more than one household as well as the lock on his own individual apartment. This has become widely used because it frees one of the burden of carrying many keys for entry into various locations when in reality, such locations are to be used by a number of different people.

Because it is necessary to put multiple capabilities on this type of key, the rod key, which has a large capacity for key numbers, is ideal since under normal conditions the rod key can form a key type of either the axial or circumferential direction. Thus, a rod-type key, even though a small key, can accommodate a great many key configurations adding to the ability of the key to be difficult to copy but permitting such key to open more than one door. In the case of a common key form, the key type is formed by angular deviations in the key in one direction and corresponding deviations in the key lock mechanism. In a rod key, the pins in the cylinder of the locking mechanism are positioned every 90° at usually four locations in the circumferential direction and the key type of the rod key takes its form correspondingly. Thus, because the traditional multiple cylinder corresponding to this key type has the same key configuration (for example, four places on the vertical and horizontal directions), when a key is inserted into each cylinder, the key way in each cylinder is different, and each time the key is inserted it is necessary to change the angular direction which in practice has proved to be a significant disadvantage and thus undesirable.

BRIEF SUMMARY OF THE INVENTION

The primary object of the present invention is to provide a lock structure and associated key which are easily manufactured and which contain none of the shortcomings associated with the prior art. The lock structure of the present invention comprises a rotor case and a rotatable pin-retaining rotor member disposed therein. The rotor member has a key way configured to receive a specifically shaped rod key. A plurality of holes extending radially outward from the key way and circumferentially thereabout are disposed in the rotor member. Pin members are slidably disposed in the holes such that insertion of the associated key causes the pin members to retract into the rotor case permitting the rotor member to rotate. A rotatable activator is coupled to the rotor and a slidable locking plate is coupled to a cam member such that rotation of the rotor causes the activator to engage the cam member and thereby move the latching plate into a retracted position. Once in this retracted position, the associated door latch is rendered movable from its initially locked extended position to an unlocked retracted position.

The novel features which are believed to be characteristic of the invention both as to its organization and method of operation, together with further objectives and advantages thereof will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limit of the invention.

DETAILED DESCRIPTION OF THE INVENTION

Figure 1:
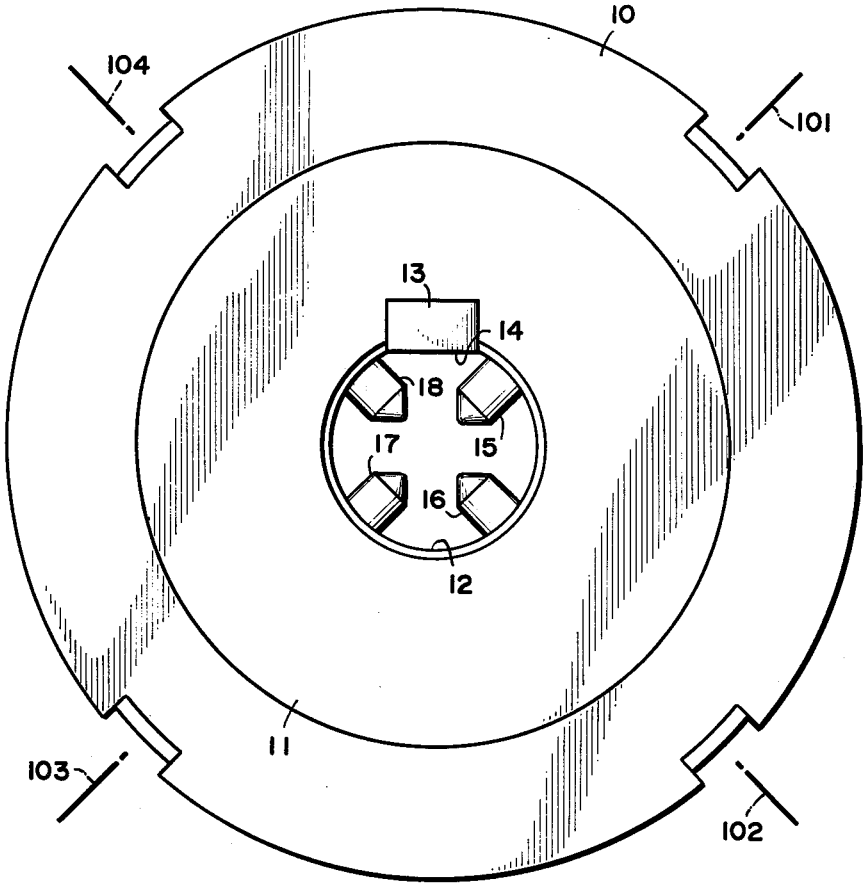
FIG. 1 is a front view of the lock of the present invention showing the inwardly extending pin members.
Figure 2:
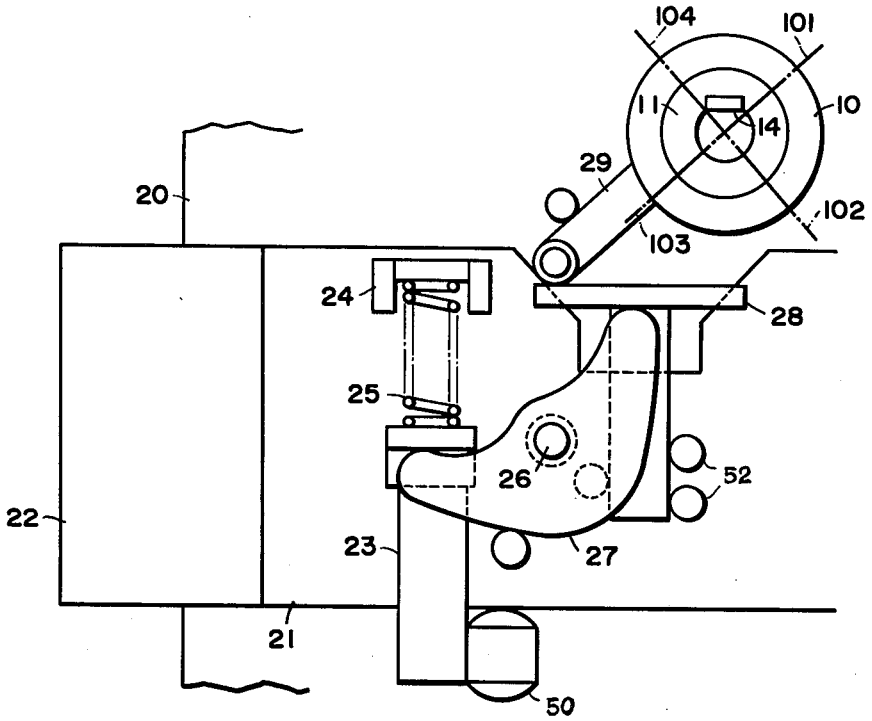
FIG. 2 is a cutaway front view of the cylinder shown in FIG. 1.

Referring first to FIGS. 1 and 2, there is shown, as the presently preferred embodiment of the present invention, the entire lock structure. The lock structure is comprised of a rotor 11 rotatably disposed within a rotor case 10. A key insertion opening 12 is set in axial alignment at the center of the rotor 11. A key pin 13 is fixed into the opening 12 by a press fit so as to form a projection 14 into the key opening 12. This forms a specific key way into which an associated rod key can be inserted. As hereinafter described, when the rod key is guided by the key way 14 into the key opening 12, the rotor 11 is rendered selectively rotatable by the rod key. Such lock structure is referred to in the art as the "cylinder" type and is formed by multiple pin positions indicated in FIG. 1 as pin positions 101, 102, 103, and 104. The key type is protected by the slide port set up in the rotor 11 and its tip is formed by tumblers 15, 16, 17 and 18 which extend inside the key insertion opening 12. Such tumblers or pick members are spring-loaded and retract into the rotor 11 and the case 10 a predetermined distance. In one embodiment, the tumblers (15, 16, 17 and 18) are made of first and second members of varying lengths such that when a proper key is inserted into key opening 12, the members which make up the tumblers are forced back into the rotor 11 and the case 10 such that the joint between the rotor 11 and the case 10 is no longer blocked by such tumbler members. When the lock mechanism is in this position, the rotor 11 is rendered selectively rotatable. More specifically, the members which make up the tumblers 11 are formed from pick pins (those members which extend into the opening 12) and lock pins (those members which extend across the joint between the rotatable member in the rotor 11 and the case 10).

Referring now to FIG. 2, the rotor case 10 and the rotor 11 are shown with respect to the other members of the entire lock structure. In the lock structure of the present invention, a latch runner 21 slidably extends out of a base plate 20 such that it can slide from its extended position to a retracted position (shown as from left to right in FIG. 2). The latch runner 21 has a latch head 22 of well known design fixed at the extended end thereof. The sliding motion of the latch runner 21 is regulated and controlled by a locking plate 23. When the locking plate 23 is in the extended position, as shown in FIG. 2, the latch runner 21 is held in the extended position. Backward movement of the latch runner 21 and the attached latch head 22 is prevented by the engagement of the locking plate 23 against a stop member 50. Should the locking plate 23 be withdrawn into a retracted position, it would no longer engage the stop member 50 and thus the latch runner 21 would be slidable into a retracted position thereby permitting the door or other locked object to open. In the presently preferred embodiment, the locking plate 23 has a generally flat top and is caused to be in an extended position because of the pressure applied at the top of the locking plate 23 by spring 25. The plate 23 in turn is held in position by a spring receiver and retaining means 24.

The top of the locking plate 23 is also engaged by a uniquely designed locking cam 27. The locking cam 27 is supported by a shaft 26 and is disposed in the locking mechanism between the locking plate 23 and a T-shaped plate member 28. The plate member 28 is held in position by pins 52 and is engaged adjacent the top thereof by an arm member 29. The arm member 29 is coupled to the cylindrically shaped rotor member 11 such that when the rotor 11 rotates in a specific direction, the arm 29 will be caused to slide across the plate 28. The plate 28 in turn engages the first end of the locking cam 27 causing it to be driven in a downward direction. The second end of locking cam 27 is driven in an upward direction thereby forcing the locking plate 23 to move upward. This causes the latch runner 21 to be rendered selectively slidable and is herein referred to as the unlocked position.

Figure 3:
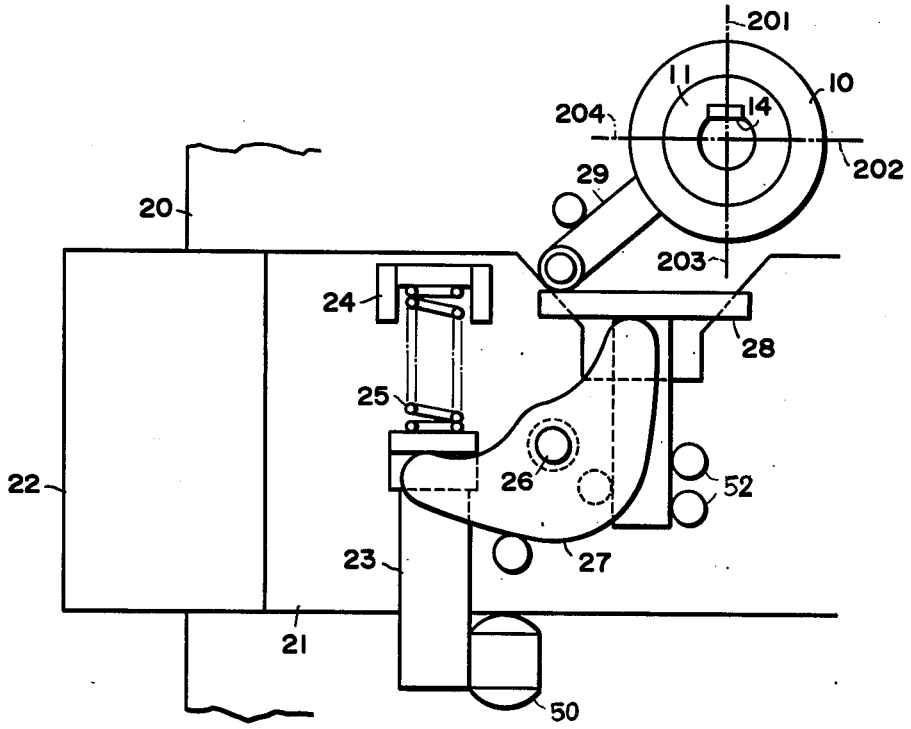
FIG. 3 is a front view of the cylinder lock wherein the pick pins are rotated so as to occupy a different angular orientation with respect to each other.

In FIG. 3 the substantially same lock structure is shown and is operable with the same key as that which could activate the lock mechanism shown with reference to FIG. 2. Note, however, that in FIG. 3 pins 201, 202, 203 and 204 are deviated by 45° from those pins 101, 102, 103 and 104 shown with reference to FIG. 2. However, because of the associated key described hereinafter, such rod key can be used to open both of the locks shown with reference to FIGS. 2 and 3.

Figure 4:
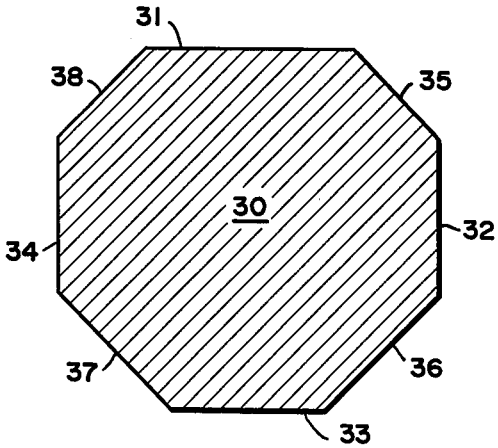
FIG. 4 is a cross-sectional view illustrating the associated rod key of the present invention.

In FIG. 4 there is shown a cross-section of a rod key 30 which has an octagonal shape appropriate for the design of the key way described hereinabove. Of the eight sides shown in FIG. 4, an upper surface 31 is cut closest to the center and serves as a key guide, engaging the key way 14 of the cylindrical lock. This key type is formed by the circumference of the rod key 30, but in this design, the key type formed by the side 31, incorporating the key guide, and three other sides 32, 33 and 34 takes the form of a key type which corresponds to the cylinder pin positions 201, 202, 203 and 204 shown in FIG. 3. The remaining surfaces 35, 36, 37 and 38 form a key type which corresponds to the cylinder pin configurations 101, 102, 103 and 104.

The lock structure set forth in this design is formed from the above-constituted parts. Since the key way of the joint cylinder is cut at the identical circumferential position, the rod key can always be inserted in the same direction in all cylinders. In the cylinder of FIG. 2, the key type employed for the rod key 30 is the key type formed by surfaces 35, 36, 37 and 38, and in the cylinder of FIG. 3, the key type used is that formed by surfaces 31, 32, 33 and 34. As described hereinabove, a rod key of this type employing multiple cylinders can always be inserted and operated in the same direction, thus enabling one to open at least two doors by using only one key. This has the advantage of enabling the user to open more than one door without utilizing more than one key.

It is understood that modifications are within the scope of this invention. For example, the shape of rod key can be other than octagonal such as, for example, hexagonal and the like. In addition, other members other than the spring 25 can be used to cause the locking plate 23 to be held in the extended position.

We claim:

1. A lock structure and associated rod key comprising:

a cylinder lock comprising:

a. a rotor case;

b. a rotatable, pin-retaining rotor member disposed in said case, said rotor member having a key way configured to receive said rod key and a plurality of holes being radially disposed in said rotor member and extending outwardly;

c. pin members slideably disposed in said holes and;

d. a slideable locking plate coupled to a cam member, said plate and cam member disposed in said lock such that rotation of said rotor causes an activator coupled to said rotor to engage said cam member and thereby to remove said locking plate into a retracted position;

a rod key comprising:

e. a stick having at least eight sides; and f. at least two different key patterns provided in alternate sides of said stick, said key patterns being arranged and configured such that they correspond with pin members of at least two different cylinder locks whereby said single rod key may unlock at least two locks with different pin member distributions.

2. The lock of claim 1 wherein said activator is an outwardly extending arm member coupled to said rotor.

3. The lock of claim 1 wherein said locking plate is spring-loaded.

4. The lock of claim 1 wherein a plate member is disposed between said activator and said cam member.

5. A lock having a slideable latch member and being activated by an associated rod key comprising:

a. a rotor case having an annular rotor member disposed therein, said rotor member containing a plurality of slideable pin members radially extending into a central key way, said pin members disposed in said rotors such that insertion of said associated rod key having at least two key patterns formed in alternate sides of said rod key causes said pin members to engage with a particular one of said key patterns and to move into a retracted position, when in said retracted position, said rotor member is rendered rotatable, whereby said single rod key may unlock at least two locks with different pin member distrubution; and b. a latch actuating assembly, said assembly being coupled to said rotor and to said latch whereby rotation of said associated key causes said latch to be movable into an open position.

6. The lock of claim 5 wherein said actuating assembly comprises:

a slidable plate member, a cam member and a locking plate, said slidable plate member coupled to said rotor such that rotation of said rotor causes said plate member to engage said cam member, said cam member in turn moving said locking plate in an unlocked position whereby said latch member is rendered slidable.

7. A lock according to claim 1 wherein said two different key patterns are formed in said rod key at an angle of 45° to each other.

8. A lock according to claim 1 wherein said rod key which opens both of said locks is inserted into both of said locks with the same angle of insertion.

* * * * *